US011168686B2

(12) United States Patent
Takai et al.

(10) Patent No.: US 11,168,686 B2
(45) Date of Patent: Nov. 9, 2021

(54) SCROLL COMPRESSOR AND METHOD OF MANUFACTURING THE SCROLL COMPRESSOR

(71) Applicant: Mitsubishi Electric Corporation, Tokyo (JP)

(72) Inventors: Akihito Takai, Tokyo (JP); Fumihiko Ishizono, Tokyo (JP); Shuhei Koyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 148 days.

(21) Appl. No.: 16/480,748

(22) PCT Filed: Mar. 29, 2017

(86) PCT No.: PCT/JP2017/012898
§ 371 (c)(1),
(2) Date: Jul. 25, 2019

(87) PCT Pub. No.: WO2018/179135
PCT Pub. Date: Oct. 4, 2018

(65) Prior Publication Data

US 2020/0032796 A1 Jan. 30, 2020

(51) Int. Cl.
*F04C 18/02* (2006.01)

(52) U.S. Cl.
CPC ..... *F04C 18/0215* (2013.01); *F04C 18/0253* (2013.01); *F04C 2230/231* (2013.01); *F04C 2240/30* (2013.01)

(58) Field of Classification Search
CPC ..... F04C 18/0215; F04C 2240/30
(Continued)

(56) References Cited

U.S. PATENT DOCUMENTS 6,071,099 A 6/2000 Noboru et al.
6,280,155 B1 * 8/2001 Dreiman ..... F04C 23/008 417/410.5

(Continued)

FOREIGN PATENT DOCUMENTS

JP H02-140481 A 5/1990
JP H03-015686 A 1/1991

(Continued)

OTHER PUBLICATIONS

International Search Report of the International Searching Authority dated Jun. 20, 2017 for the corresponding International application No. PCT/JP2017/012898(and English translation).

(Continued)

*Primary Examiner* — Connor J Tremarche
(74) *Attorney, Agent, or Firm* — Posz Law Group, PLC

(57) ABSTRACT

A scroll compressor includes an orbiting scroll, a fixed scroll, and a shell. The fixed scroll is configured to form a compression chamber together with the orbiting scroll. The shell accommodates the orbiting scroll and the fixed scroll. The fixed scroll includes a base plate and a scroll body. The base plate is fixed to the shell. The scroll body projects from the base plate toward the orbiting scroll. The base plate has a stress absorber that is formed outside the scroll body in a radial direction and that is configured to absorb stress from an outer region in the radial direction. A weld joint is formed in an overlap region where the shell and the base plate are fixed to each other and overlap each other. The stress absorber is provided on a line that passes through a center of the base plate and the weld joint.

12 Claims, 8 Drawing Sheets

(58) Field of Classification Search
USPC ..... 418/55.1
See application file for complete search history.

(56) References Cited

U.S. PATENT DOCUMENTS

| | | | | |
|---|---|---|---|---|
| 2006/0159579 | A1 | 7/2006 | Skinner et al. | |
| 2016/0040667 | A1* | 2/2016 | Choi | F04C 18/0246 418/55.1 |

FOREIGN PATENT DOCUMENTS

| | | | | |
|---|---|---|---|---|
| JP | H0315686 | A | * | 1/1991 |
| JP | H05-209591 | A | | 8/1993 |
| JP | H09-303277 | A | | 11/1997 |
| JP | 2002-115660 | A | | 4/2002 |
| JP | 2013-238142 | A | | 11/2013 |

OTHER PUBLICATIONS

Office Action dated May 12, 2020 issued in corresponding JP patent application No. 2019-508423 (and English translation).

* cited by examiner

SCROLL COMPRESSOR AND METHOD OF MANUFACTURING THE SCROLL COMPRESSOR

CROSS REFERENCE TO RELATED APPLICATION

This application is a U.S. national stage application of PCT/JP2017/012898 filed on Mar. 29, 2017, the contents of which are incorporated herein by reference.

TECHNICAL FIELD

The present invention relates to a structure for fixing a fixed scroll in a scroll compressor.

BACKGROUND ART

In a scroll compressor, an orbiting scroll is supported by a frame fixed in a shell, and a fixed scroll is provided to face the orbiting scroll. A crankshaft is attached to the orbiting scroll. When the crankshaft is rotated, the orbiting scroll shakes while the orbiting scroll faces the fixed scroll. Thus, refrigerant is compressed in a compression chamber formed by the orbiting scroll and the fixed scroll (for example, see Patent Literatures 1 and 2).

CITATION LIST

Patent Literature

Patent Literature 1: Japanese Unexamined Patent Application Publication No. 2013-238142

Patent Literature 2: Japanese Unexamined Patent Application Publication No. 2-140481

SUMMARY OF INVENTION

Technical Problem

In the scroll compressors of Patent Literatures 1 and 2, a circumferential wall of the frame extends toward the fixed scroll, and the fixed scroll is fixed to a distal end of the circumferential wall by bolts or other parts. Consequently, there is a problem in that a space where the orbiting scroll is disposed is small because of the presence of the wall of the frame.

To address this problem, a structure has been proposed with which the fixed scroll is fixed to the shell to eliminate, from the frame, the circumferential wall for fixing the fixed scroll. With this structure, fixing strength equal to that of the related-art fixing method by which the fixed scroll is fixed to the frame by the bolts is required. Here, the fixed scroll may be fixed to the shell by a fixing method such as shrink fitting and spot welding. However, with any of these fixing methods, the fixed scroll may strain due to stress in a fixing step, leading to deformation of a scroll body of the fixed scroll. This deformation may reduce efficiency of compression.

The present invention is made to address the above-described problem. An object of the present invention is to provide a scroll compressor and a method of manufacturing the scroll compressor. This scroll compressor can suppress reduction in efficiency of compression caused by the occurrence of strain of a fixed scroll.

Solution to Problem

A scroll compressor of an embodiment of the present invention includes an orbiting scroll, a fixed scroll, and a shell. The fixed scroll is configured to form a compression chamber together with the orbiting scroll. The shell accommodates the orbiting scroll and the fixed scroll. The fixed scroll includes a base plate and a scroll body. The base plate is fixed to the shell. The scroll body projects from the base plate toward the orbiting scroll. The base plate has a stress absorber that is formed outside the scroll body in a radial direction and that is configured to absorb stress from an outer region in the radial direction.

Advantageous Effects of Invention

According to an embodiment of the present invention, reduction in efficiency of compression caused by the occurrence of strain of the fixed scroll can be suppressed.

DESCRIPTION OF EMBODIMENTS

Figure 1:
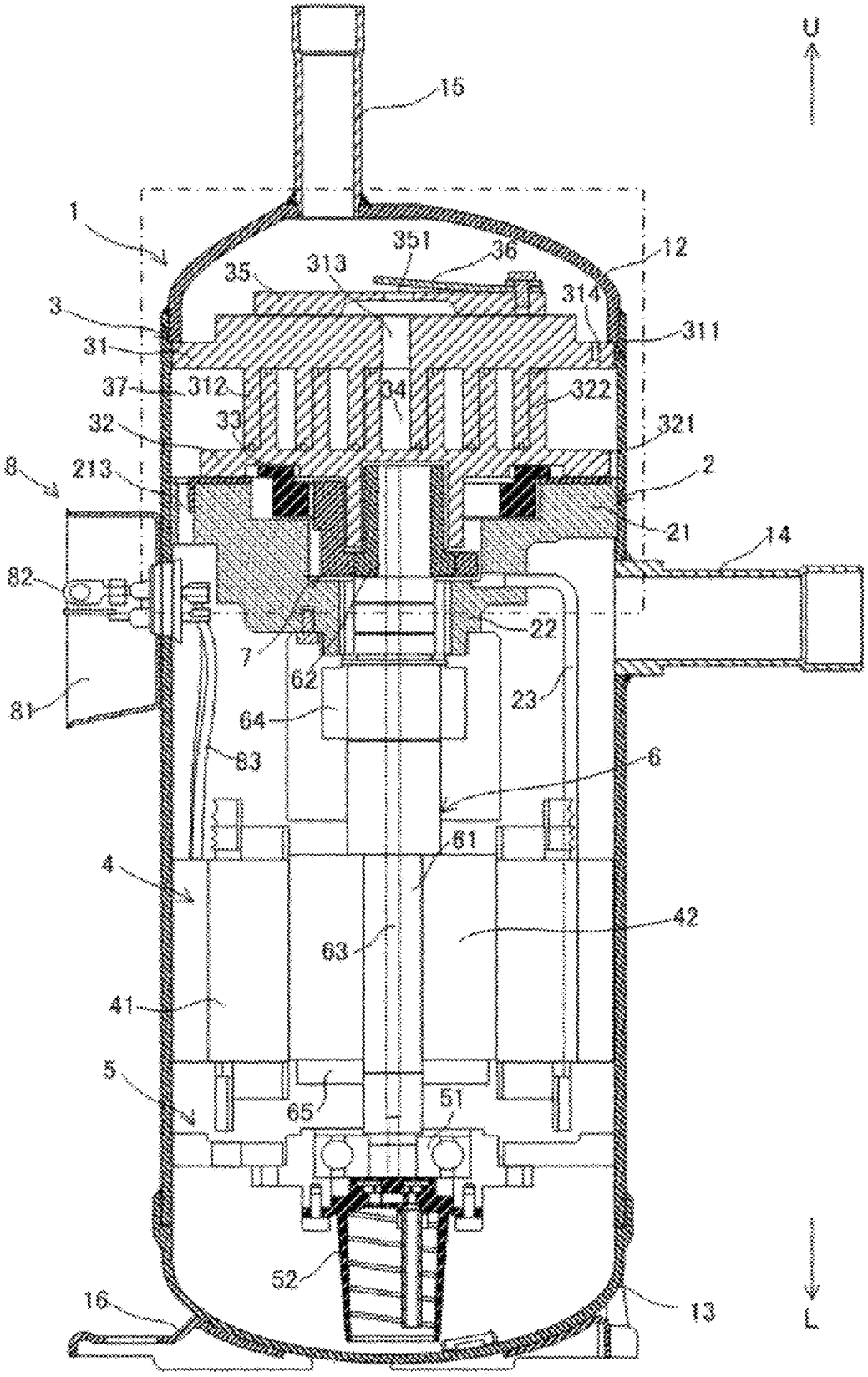
FIG. 1 is a schematic longitudinal sectional view of a scroll compressor according to Embodiment 1 of the present invention.

Hereinafter, an embodiment of the present invention will be described with reference to the drawings. In the drawings, the same or equivalent parts are denoted by the same reference signs, and description of the parts is appropriately omitted or simplified. Furthermore, the shapes, sizes, arrangements, and other features of structures illustrated in the drawings can be appropriately changed within the scope of the present invention.

Embodiment 1

Figure 2:
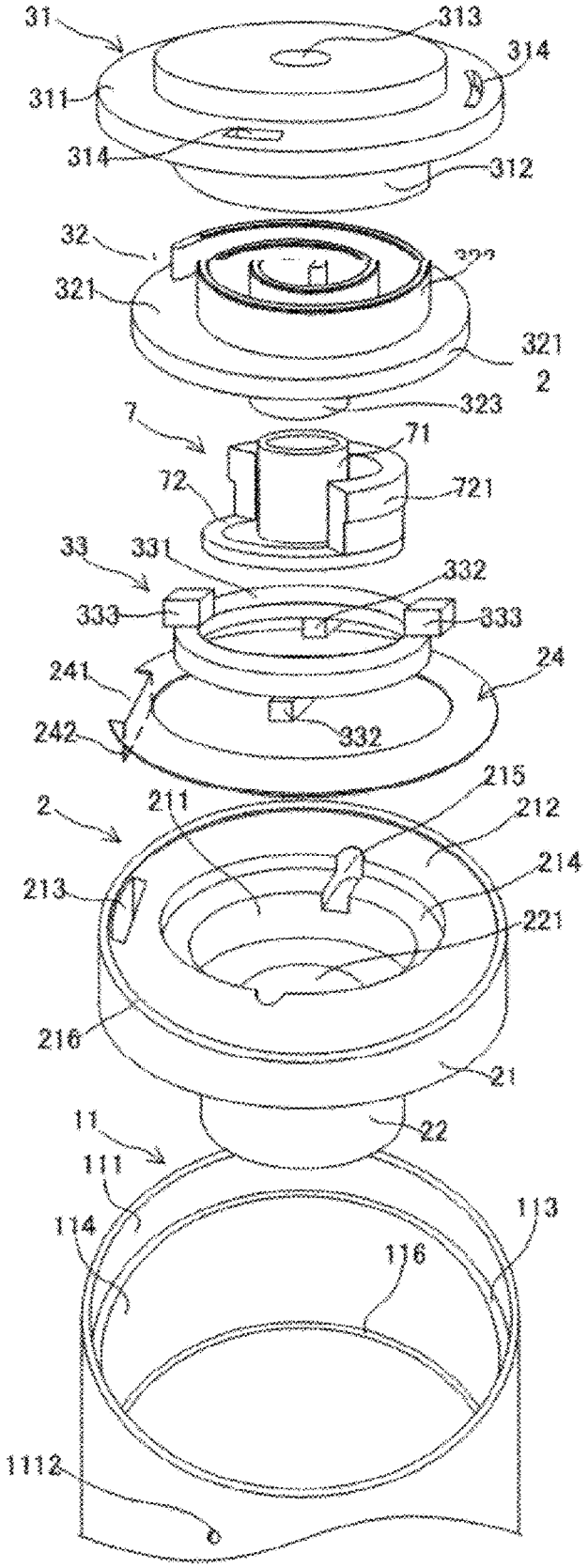
FIG. 2 is an exploded perspective view of part of the structure of the scroll compressor according to Embodiment 1 of the present invention.
Figure 3:
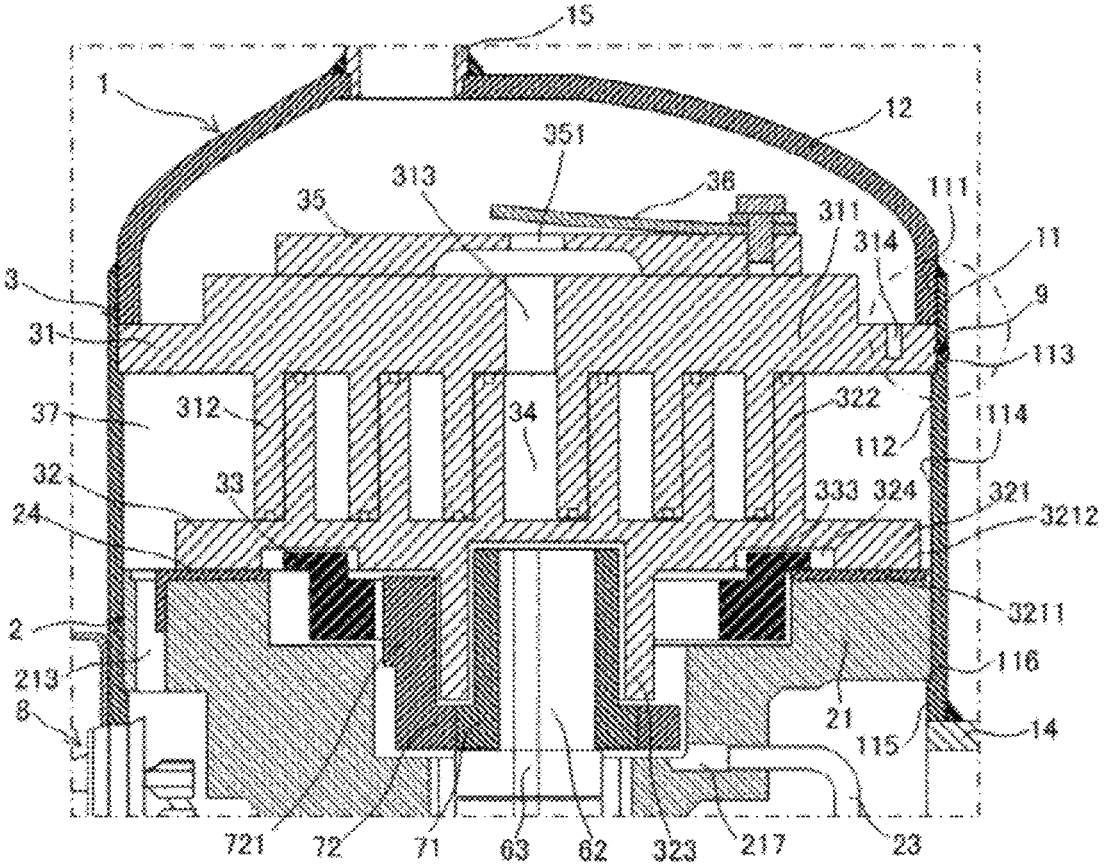
FIG. 3 is an enlarged view of a region surrounded by a dotted chain line in FIG. 1.

Embodiment 1 is described below. FIG. 1 is a schematic longitudinal sectional view of a scroll compressor according to Embodiment 1. FIG. 2 is an exploded perspective view of part of the structure of the scroll compressor according to Embodiment 1 of the present invention. FIG. 3 is an enlarged view of a region surrounded by a dotted chain line in FIG. 1. The compressor illustrated in FIG. 1 is a vertical scroll compressor to be used with the central axis of a crankshaft being substantially perpendicular to the ground.

The scroll compressor includes a shell 1, a main frame 2, a compression mechanism unit 3, a drive mechanism unit 4, a sub-frame 5, a crankshaft 6, a bushing 7, and a power feed unit 8. Hereinafter, regarding the directions from the main frame 2, a portion where the compression mechanism unit 3 is provided is referred to as one end portion U (upper portion), and a portion where the drive mechanism unit 4 is provided is referred to as another end portion L (lower portion) for description.

For example, the shell 1 is made of an electrically conductive material such as metal and is a cylindrical housing both ends of which are closed. The shell 1 includes a main shell 11, an upper shell 12, and a lower shell 13. The main shell 11 has a cylindrical shape. A suction pipe 14 is connected to a side wall of the main shell 11 by, for example, brazing. The suction pipe 14 is for introducing refrigerant into the shell 1 and communicates with the inside of the main shell 11. The upper shell 12 is a first shell having a substantially hemispherical shape. Part of a side wall of the upper shell 12 is connected to an upper end part of the main shell 11 by, for example, brazing. Thus, an opening at an upper portion of the main shell 11 is covered by the upper shell 12. A discharge pipe 15 is connected to an upper part of the upper shell 12 by, for example, brazing. The discharge pipe 15 is for discharging the refrigerant to the outside of the shell 1 and communicates with an inner space of the main shell 11. The lower shell 13 is a second shell having a substantially hemispherical shape. Part of a side wall of the lower shell 13 is connected to a lower end part of the main shell 11 by, for example, brazing. Thus, an opening at a lower portion of the main shell 11 is covered by the lower shell 13. The shell 1 is supported by a fixing base 16 having a plurality of screw holes. The scroll compressor can be fixed to another part such as a housing of an outdoor unit by screwing screws into the plurality of screw holes provided in the fixing base 16.

The main frame 2 is a hollow metal frame having a cavity. The main frame 2 is disposed in the shell 1. The main frame 2 includes a main body part 21, a main bearing part 22, and a lubricant return pipe 23. The main body part 21 is fixed to a portion of an inner wall surface of the main shell 11 close to the one end portion U.

An accommodating space 211 is provided in the main body part 21 along the longitudinal direction of the shell 1. The accommodating space 211 is open at a portion of the accommodating space 211 close to the one end portion U and has a stepped shape in which the space reduces toward the other end portion L. An annular flat surface 212 is formed in a portion of the main body part 21 close to the one end portion U in such a manner that the flat surface 212 surrounds the accommodating space 211. A ring-shaped thrust plate 24 made of a steel-based material such as a valve steel is disposed on the flat surface 212. Thus, the thrust plate 24 serves as a thrust bearing according to Embodiment 1. Part of the thrust plate 24 is cut and bent toward the other end portion L. Thus, a cut 241 and a bent part 242 are formed. A suction port 213 is formed at a portion not overlapped by the thrust plate 24 at an outer end portion of the flat surface 212, that is, a portion facing the cut 241. The suction port 213 is a space that penetrates through in the up-down direction of the main body part 21, that is, from a portion close to the upper shell 12 to a portion close to the lower shell 13. As illustrated in FIG. 3, the bent part 242 of the thrust plate 24 is inserted into this suction port 213, and both ends of the bent part 242 are engaged with both wall surfaces of the suction port 213. This engagement suppresses rotation of the thrust plate 24 while the thrust plate 24 faces the main frame 2. The number of the suction port 213 is not limited to one. A plurality of the suction ports 213 may be formed.

An Oldham accommodating part 214 is formed at part of the step portion of the main frame 2 closer to the other end portion L than the flat surface 212. The Oldham accommodating part 214 has first Oldham grooves 215. A pair of the first Oldham grooves 215 are provided to face each other. The main bearing part 22 is formed at a portion closer to the other end portion L than the main body part 21 and formed continuous with the main body part 21. The main bearing part 22 has a shaft hole 221 inside the main bearing part 22. The shaft hole 221 penetrates through the main bearing part 22 in the up-down direction. A portion of the shaft hole 221 close to the one end portion U communicates with the accommodating space 211. Lubricant stored in the accommodating space 211 is returned to a lubricant storage in the lower shell 13 through the lubricant return pipe 23. The lubricant return pipe 23 is inserted into and fixed to a lubricant exhaust hole that penetrates from the inside to the outside of the main frame 2.

The lubricant is stored in a lower part of the shell 1, that is, in the lower shell 13, sucked up by an lubricant pump 52, which will be described later, and passes through a lubricant channel 63 in the crankshaft 6 to reduce wear of parts of, for example, the compression mechanism unit 3, which are in mechanical contact with one another, adjust the temperatures of sliding portions, and improve sealing properties. Preferably, the lubricant has, for example, good lubricating characteristics, good electrical insulating properties, high stability, high dissolubility in the refrigerant, and high fluidity at low-temperature. It is also preferable that the lubricant have an appropriate viscosity. As the lubricant, for example, an ester-based (POE), ether-based (PVE), or polyalkylene glycol-based (PAG) oil can be used.

The compression mechanism unit 3 compresses the refrigerant. The compression mechanism unit 3 is a scroll compression mechanism that includes a fixed scroll 31 and an orbiting scroll 32. The fixed scroll 31 is made of metal such as cast iron and includes a first base plate 311 and a first scroll body 312. The first base plate 311 has a discoidal shape. A discharge port 313 that penetrates through the first base plate 311 in the up-down direction is formed at or close to the center of the first base plate 311. The first scroll body 312 projects from a surface of the first base plate 311 close to the other end portion L to form a scroll-shaped wall. A distal end of the first scroll body 312 projects toward the other end portion L. The orbiting scroll 32 is made of metal such as aluminum and includes a second base plate 321, a second scroll body 322, a cylindrical part 323, and second Oldham grooves 324. The second base plate 321 has a discoidal shape and includes a one-end surface on which the first scroll body 312 is formed, another-end surface at least part of an outer circumferential region of which serves as a sliding surface 3211, and a side surface 3212 that is located at an outermost part in the radial direction and connects the one-end surface and the other-end surface to each other. The second base plate 321 is supported (borne) by the main frame 2 in such a manner that the sliding surface 3211 can slide against the thrust plate 24. The second scroll body 322 projects from the one-end surface of the second base plate 321 to form a scroll-shaped wall. A distal end of the second scroll body 322 projects toward the one end portion U. A sealing part that suppresses leakage of the refrigerant is provided at the distal end part of each of the first scroll body 312, which projects from the first base plate 311 of the fixed scroll 31 toward the orbiting scroll 32, and the second scroll body 322, which projects from the second base plate 321 of the orbiting scroll 32 toward the fixed scroll 31. The cylindrical part 323 is a cylindrical boss that projects from the center or a region close to the center of the other-end surface of the second base plate 321 toward the other end portion L. A journal bearing, that is, an orbiting bearing by which a slider 71, which will be described later, is supported in such a manner that the slider 71 can be rotated is provided in an inner circumferential surface of the cylindrical part 323 in such a manner that the central axis of the journal bearing is parallel to the central axis of the crankshaft 6. The second Oldham grooves 324 each have an oblong shape and are formed in the other-end surface of the second base plate 321. A pair of the second Oldham grooves 324 are provided to face each other. A line passing through the pair of second Oldham grooves 324 is perpendicular to a line passing through the pair of first Oldham grooves 215.

An Oldham ring 33 is provided in the Oldham accommodating part 214 of the main frame 2. The Oldham ring 33 includes a ring part 331, first key parts 332, and second key parts 333. The ring part 331 has a ring shape. A pair of the first key parts 332 face each other and are formed on a surface of the ring part 331 close to the other end portion L. The pair of first key parts 332 are accommodated in the pair of first Oldham grooves 215 of the main frame 2. A pair of the second key parts 333 face each other and are formed on a surface of the ring part 331 close to the one end portion U. The pair of second key parts 333 are accommodated in the pair of second Oldham grooves 324 of the orbiting scroll 32. When the orbiting scroll 32 orbits due to rotation of the crankshaft 6, the first key parts 332 slide in the first Oldham grooves 215, and the second key parts 333 slide in the second Oldham grooves 324. Thus, the Oldham ring 33 prevents the orbiting scroll 32 from rotating about its own axis.

A compression chamber 34 is formed by engaging the first scroll body 312 of the fixed scroll 31 and the second scroll body 322 of the orbiting scroll 32 with each other. The volume of the compression chamber 34 reduces from outer toward inner portions in the radial direction. Thus, the refrigerant is gradually compressed by introducing the refrigerant from outer ends of the scroll bodies and moving the refrigerant toward the center. The compression chamber 34 communicates with the discharge port 313 at a central part of the fixed scroll 31. A muffler 35 having a discharge hole 351 and a discharge valve 36 are provided on a surface of the fixed scroll 31 close to the one end portion U. The discharge valve 36 opens and closes the discharge hole 351 as predetermined and prevents backflow of the refrigerant.

The refrigerant is, for example, halogenated hydrocarbon having a double bond of carbon in the composition, halogenated hydrocarbon having no double bond of carbon in the composition, hydrocarbon, or a mixture containing these types of hydrocarbon. The halogenated hydrocarbon having a double bond of carbon is an HFC refrigerant the ozone depletion potential of which is zero or a fluorocarbon-based low GWP refrigerant. The low GWP refrigerant is, for example, an HFO refrigerant. Examples of the HFO refrigerant include tetrafluoropropene represented by a chemical formula $C_3H_2F_4$ such as HFO1234yf, HFO1234ze, and HFO1243zf. Examples of the halogenated hydrocarbon having no double bond of carbon include a refrigerant mixed with R32 (difluoromethane) represented as $CH_2F_2$, R41, or other refrigerant. Examples of the hydrocarbon include a natural refrigerant such as propane and propylene. Examples of the mixture include a mixed refrigerant in which HFO1234yf, HFO1234ze, HFO1243zf, or other refrigerant is mixed with R32, R41, or other refrigerant.

The drive mechanism unit 4 is provided at a portion of the main frame 2 in the shell 1 that is close to the other end portion L. The drive mechanism unit 4 includes a stator 41 and a rotor 42. The stator 41 has a ring shape and is formed by, for example, winding a wire around a core, which is formed by stacking a plurality of electromagnetic steel sheets, with an insulating layer interposed between the core and the wire. The stator 41 is fixedly supported at the inside of the main shell 11 by, for example, shrink fitting. The rotor 42 includes a permanent magnet disposed in a core formed by stacking a plurality of electromagnetic steel sheets. The rotor 42 has a cylindrical shape having a through hole that penetrates, in the up-down direction, through the rotor 42 at the center. The rotor 42 is disposed in an inner space of the stator 41.

The sub-frame 5 is a metal frame and provided at a portion closer to the other end portion L than the drive mechanism unit 4 in the shell 1. The sub-frame 5 is fixedly supported on an inner circumferential surface of a portion of the main shell 11 close to the other end portion L by shrink fitting, welding, or other method. The sub-frame 5 includes a sub-bearing part 51 and a lubricant pump 52. The sub-bearing part 51 is a ball bearing provided at an upper central part of the sub-frame 5. The sub-bearing part 51 has a hole that penetrates, in the up-down direction, through a center of the sub-bearing part 51. The lubricant pump 52 is provided at a lower central part of the sub-frame 5. The lubricant pump 52 is disposed in such a manner that at least part of the lubricant pump 52 is immersed in the lubricant stored in the lubricant storage of the shell 1.

The crankshaft 6 is a rod-shaped long metal part and provided in the shell 1. The crankshaft 6 includes a main shaft part 61, an eccentric shaft part 62, and the lubricant channel 63. The main shaft part 61 is included in a main part of the crankshaft 6 and disposed in such a manner that the central axis of the main shaft part 61 is coincident with the central axis of the main shell 11. The rotor 42 is in contact with and fixed to an outer surface of the main shaft part 61. The eccentric shaft part 62 is provided at a portion of the main shaft part 61 that is close to the one end portion U in such a manner that the central axis of the eccentric shaft part 62 is decentered from the central axis of the main shaft part 61. The lubricant channel 63 penetrates, in the up-down direction, through the main shaft part 61 and the eccentric shaft part 62. A portion of the main shaft part 61 of the crankshaft 6 close to the one end portion U is inserted into the main bearing part 22 of the main frame 2 and a portion of the main shaft part 61 of the crankshaft 6 close to the other end portion L is inserted into and fixed to the sub-bearing part 51 of the sub-frame 5. Thus, the eccentric shaft part 62 is disposed in the cylinder of the cylindrical part 323, and an outer circumferential surface of the rotor 42 is spaced from an inner circumferential surface of the stator 41 with a predetermined gap between the rotor 42 and the stator 41. Furthermore, a first balancer 64 is provided at a portion of the main shaft part 61 close to the one end portion U, and a second balancer 65 is provided at a portion of the main shaft part 61 close to the other end portion L, to compensate for imbalance due to shake of the orbiting scroll 32.

The bushing 7 is made of metal such as iron and connects the orbiting scroll 32 and the crankshaft 6 to each other. According to Embodiment 1, the bushing 7 includes two parts, that is, the slider 71 and a balance weight 72. The slider 71 is a cylindrical part having a flange. The slider 71 is fitted into the eccentric shaft part 62 and the cylindrical part 323. As illustrated in FIG. 2, the balance weight 72 is a ring-shaped part and includes a weight part 721 having a substantially C shape seen from the one end portion U. The balance weight 72 is decentered from the center of rotation to cancel out a centrifugal force of the orbiting scroll 32. The balance weight 72 and the flange of the slider 71 are fitted together by, for example, shrink fitting.

The power feed unit 8 feeds power to the scroll compressor and is provided on an outer circumferential surface of the main shell 11 of the shell 1. The power feed unit 8 includes a cover 81, a power feed terminal 82, and wiring 83. The cover 81 has a bottom and an opening. The power feed terminal 82 includes a metal part. One end of the power feed terminal 82 is provided inside the cover 81 and the other end of the power feed terminal 82 is provided in the shell 1. The wiring 83 is connected to the power feed terminal 82 at one end and connected to the stator 41 at the other end.

Figure 4:
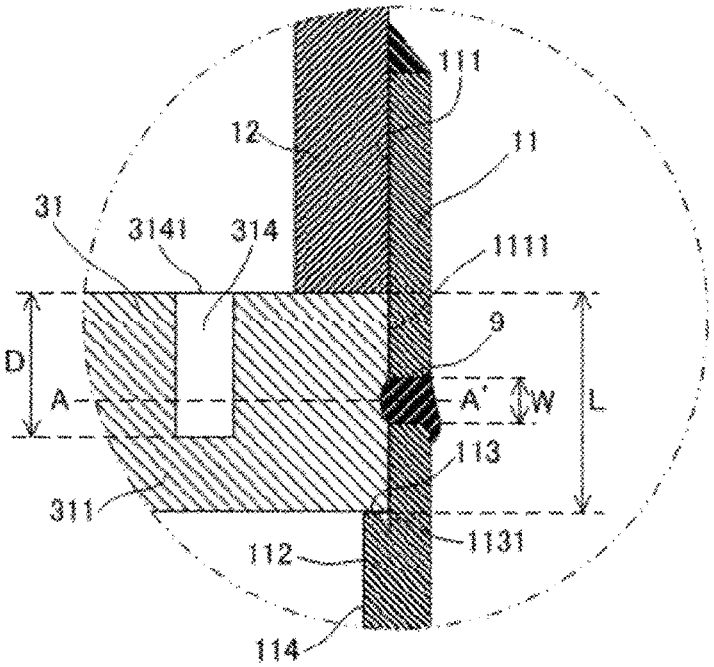
FIG. 4 is an enlarged view of a region surrounded by a two-dot chain line in FIG. 3.

Here, the relationship between the shell 1 and the compression mechanism unit 3 is described in detail with reference to FIGS. 3 and 4. FIG. 4 is an enlarged view of a region surrounded by a two-dot chain line in FIG. 3.

As illustrated in FIG. 4, the shell 1 has a first inner wall surface 111, a first projection 112, and a first positioning surface 113. The first projection 112 projects from the first inner wall surface 111 and serves as a location at which the fixed scroll 31 is positioned. The first positioning surface 113 is formed on the first projection 112 and oriented toward the upper shell 12. That is, the main shell 11 has a step portion the inner diameter of which increases toward the other end portion L. The fixed scroll 31 is fixed to the first inner wall surface 111 by, for example, shrink fitting or welding in a state in which the fixed scroll 31 is positioned at the first positioning surface 113. With this structure, unlike the related art, a wall for fixedly screwing the fixed scroll 31 in the main frame 2 is not required. That is, the side surface 3212 of the second base plate 321 of the orbiting scroll 32 and the inner wall surface of the main shell 11 face each other without a wall of the main frame 2 interposed between the side surface 3212 of the second base plate 321 and the inner wall surface of the main shell 11. This structure can increase, compared to the related art, the size of a refrigerant introduction space 37 provided between the first base plate 311 of the fixed scroll 31 and the thrust bearing of the main frame 2 in the main shell 11. Furthermore, the structure of the main frame 2 is simplified. Thus, processability is improved and the weight can be reduced.

Various advantages can be obtained when the size of the refrigerant introduction space 37 is increased. For example, with a structure as in Embodiment 1, the pressure in a space combined by the main shell 11 in which the drive mechanism unit 4 is disposed and the refrigerant introduction space 37 is reduced compared to the pressure in the refrigerant introduction space 37. With this structure, the second base plate 321 of the orbiting scroll 32 is pressed against the thrust plate 24 by the pressure of the compressed refrigerant. This action generates a thrust load at sliding portions. To address this problem, the thrust load can be reduced by increasing the diameter of the second base plate 321 of the orbiting scroll 32 and the diameter of the thrust plate 24 to increase a sliding area without changing the design of the scroll bodies and other parts from those of the related art. Also, a size-reduced compressor having the characteristics equal to those of the related art can be obtained by reducing the diameter of the main shell 11 without changing the size of the orbiting scroll 32.

Also, the main frame 2 is fixed to a second inner wall surface 114 by, for example, shrink fitting in a state in which the main frame 2 is positioned at a second positioning surface 116 of a second projection 115 projecting from the second inner wall surface 114 of the shell 1.

Figure 5:
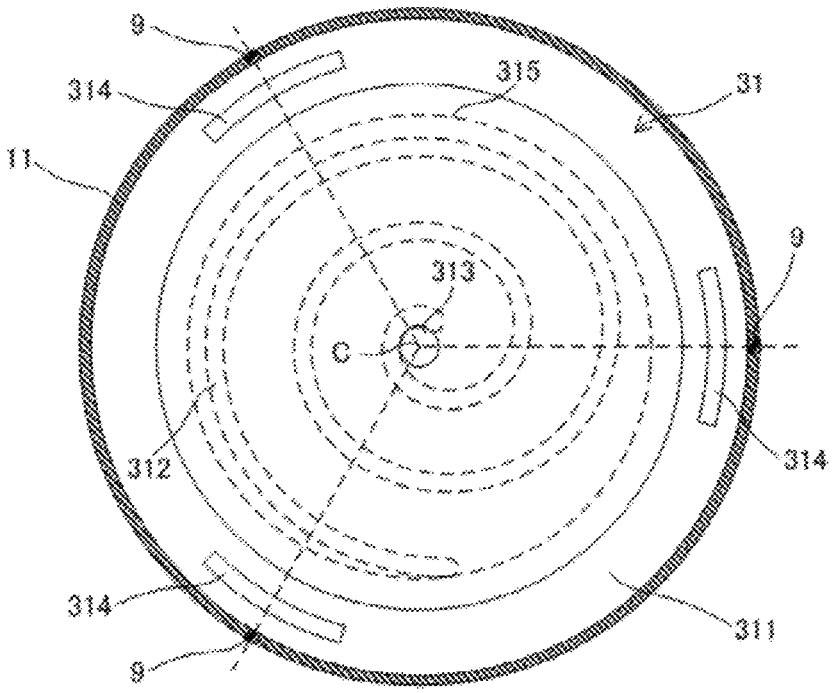
FIG. 5 is a top view of a fixed scroll fixed to a main shell.

Next, the structure for fixing the main shell 11 and the fixed scroll 31 is described in more detail with reference to FIGS. 4 and 5. FIG. 5 is a top view of the fixed scroll fixed to the main shell.

Stress absorbers are formed in the first base plate 311 of the fixed scroll 31. The stress absorbers absorb the stress from the outside in the radial direction and are, according to Embodiment 1, recesses 314 having respective openings 3141 provided at portions of the first base plate 311 close to the one end portion U and opening at the one end portion U. As illustrated in FIG. 5, the recesses 314 each have an arcuate shape formed along the outer circumference of the first base plate 311 in a region outside a formation region 315 of the first scroll body 312 in the radial direction. That is, the recesses 314 are formed close to an overlap region 1111 where the main shell 11 and the first base plate 311 of the fixed scroll 31 are fixed to each other and overlap each other.

Furthermore, weld joints 9 are formed in the overlap region 1111 of the main shell 11 and the first base plate 311. The weld joints 9 are welding marks formed by spot welding. A portion of each of the weld joints 9 at or close to the inside of the compressor penetrates into the side surface of the fixed scroll 31, and a portion of the weld joint 9 at or close to the outside of the compressor slightly increases in width and has a shape that partially rises to extend beyond the side surface of the main shell 11. As illustrated in FIG. 5, the recesses 314 serving as the stress absorbers are each provided on a line passing through a center C of the first base plate 311 and the corresponding one of the weld joints 9. According to Embodiment 1, three weld joints 9 and three recesses 314 are formed. Angles between the lines passing through the center C of the first base plate 311 and the weld joints 9 are about 120 degrees. Furthermore, each of the weld joints 9 is formed in such a manner that, in the thickness direction of the first base plate 311, the center of the weld joint 9 is coincident with a line A-A' perpendicular to the wall surface of the main shell 11 and passing through the midpoint of the overlap region 1111. In addition, when the length of the overlap region 1111 is L, the depth of the recesses 314 is D, and the width of the weld joints 9 is W, relationships are satisfied in which the depth D of the recesses 314 is within a range of the length L of the overlap region 1111, and the width W of the weld joints 9 is within a range of the depth D of the recesses 314.

Operation of the scroll compressor is described. When the power is supplied to the power feed terminal 82 of the power feed unit 8, as torque is generated between the stator 41 and the rotor 42, the crankshaft 6 is rotated. The rotation of the crankshaft 6 is transmitted to the orbiting scroll 32 through the eccentric shaft part 62 and the bushing 7. Rotation about its own axis of the orbiting scroll 32 to which the rotation drive force is transmitted is regulated by the Oldham ring 33, and the orbiting scroll 32 orbits in a decentered manner while the orbiting scroll 32 faces the fixed scroll 31. In so doing, another-end surface of the orbiting scroll 32 slides against the thrust plate 24.

As the orbiting scroll 32 shakes, the refrigerant sucked into the shell 1 from the suction pipe 14 reaches the refrigerant introduction space 37 through the suction port 213 of the main frame 2 and is moved into the compression chamber 34 formed by the fixed scroll 31 and the orbiting scroll 32. Then, as the orbiting scroll 32 orbits in the decentered manner, the refrigerant is reduced in volume and compressed while the refrigerant is moved from an outer circumferential part toward the center. The orbiting scroll 32 orbiting in the decentered manner is moved together with the bushing 7 in the radial direction by the centrifugal force of the orbiting scroll 32, thereby a side wall surface of the second scroll body 322 and a side wall surface of the first scroll body 312 are brought into close contact with each other. The compressed refrigerant is moved from the discharge port 313 of the fixed scroll 31 to the discharge hole 351 of the fixed scroll 31 and, resisting the discharge valve 36, discharged to the outside of the shell 1.

Figure 6:
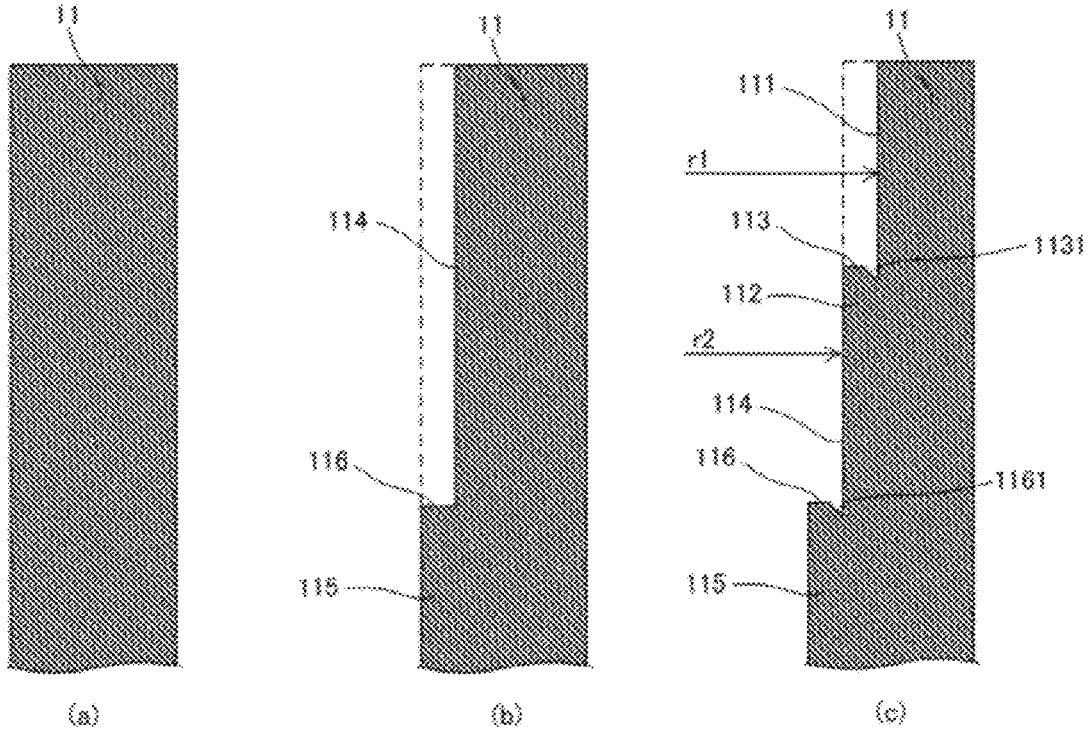
FIG. 6 illustrates a method of manufacturing the main shell.

A method of manufacturing the scroll compressor according to Embodiment 1, in particular, processing of the main shell 11 and arrangement of the components, for example, the fixed scroll 31 are described more in detail with reference to FIG. 6. FIG. 6 illustrates the method of manufacturing the main shell. In FIG. 6, the section of one of the walls of the main shell 11 is illustrated for clear understanding, and the dimensions and the thickness are different from the actual dimensions and the thickness.

First, a cutting brush or other tool (not illustrated) is inserted from a portion of an unprocessed main shell 11 as illustrated in (a) close to the one end portion U to cut the inner wall surface in the thickness direction. Thus, a step between the second inner wall surface 114 and the second projection 115 is formed as illustrated in (b). Next, the inner wall surface is cut by a predetermined depth in the thickness direction by using the cutting brush or other tool in a portion of the second inner wall surface 114 spaced from the second projection 115 by a predetermined distance along a direction toward the one end portion U. Thus, a step between the first inner wall surface 111 and the first projection 112 is formed as illustrated in (c). Consequently, an inner diameter r1 of the first inner wall surface 111 is larger than an inner diameter r2 of the second inner wall surface 114. Furthermore, the first projection 112 is formed in a portion closer to the one end portion U than is the second projection 115, and the inner wall surface of the first projection 112 also serves as the second inner wall surface 114. The second projection 115 may be formed after the first projection 112 has been formed. The thickness of the main shell 11 is, for example, from 4 to 6 mm, and the heights of the projections, that is, the depths of cutting represented by dotted lines are, for example, about 0.3 mm.

Furthermore, after cutting illustrated in (b) and (c) has been performed, outer diameter processing is performed, with, for example, a rhombic insert, on a portion of the first projection 112 connected to the first inner wall surface 111 (portion of the first positioning surface 113 close to the first inner wall surface 111) and a portion of the second projection 115 connected to the second inner wall surface 114 (portion of the second positioning surface 116 close to the second inner wall surface 114). Thus, recesses 1131 and 1161 recessed toward the lower shell 13 are formed. The recesses 1131 and 1161 are reliefs for removal, by cutting, of curved surfaces that are likely to be formed at the above-described connecting portions. That is, when cutting is performed, the connecting portion between the first inner wall surface 111 and the first positioning surface 113 is likely to be rounded instead of being squared. In the case where these portions are rounded, even when the fixed scroll 31 is disposed on the first projection 112, the fixed scroll 31 is away from the first positioning surface 113 instead of being in contact with the first positioning surface 113. This arrangement degrades positioning accuracy. In contrast, with the recess 1131, the fixed scroll 31 is reliably brought into contact with the first positioning surface 113. Thus, positioning accuracy can be improved. Likewise, with the recess 1161, positioning accuracy for the main frame 2 can be improved. The recesses 1131 and 1161 are recessed toward the lower shell 13. Compared to the case where the recesses are formed in the radial direction of the main shell, reduction in thickness of the main shell 11 can be suppressed. Thus, reduction in strength can be suppressed.

Next, the main frame 2 is inserted from a portion of the main shell 11, which has formed as above, close to the one end portion U. The main frame 2 is brought into surface contact with the second positioning surface 116 of the second projection 115 to be positioned in the height direction. In this state, the main frame 2 is fixed to the second inner wall surface 114 by, for example, shrink fitting or arc spot welding. The crankshaft 6 is inserted into the shaft hole 221 of the main frame 2. Subsequently, the bushing 7 is attached to the eccentric shaft part 62, and further, the Oldham ring 33 and the orbiting scroll 32 are arranged.

Next, the fixed scroll 31 is inserted from the portion of the main shell 11 close to the one end portion U. The fixed scroll 31 is brought into surface contact with the first positioning surface 113 of the first projection 112 to be positioned in the height direction. According to Embodiment 1, there are no parts such as screws used, in the related art, to position the fixed scroll 31 in the circumferential direction. Thus, the fixed scroll 31 can be rotated while the fixed scroll 31 faces the orbiting scroll 32 until the fixed scroll 31 is fixed to the first inner wall surface 111. Consequently, the positional relationship between the first scroll body 312 and the second scroll body 322 may vary, leading to variation in compression from one scroll compressor product to another or compression failure. Thus, after the fixed scroll 31 has been rotated to adjust the phase so that the positional relationship of the first scroll body 312 with the second scroll body 322 of the orbiting scroll 32 is established as predetermined, a fixing step in which the fixed scroll 31 is fixed to the first inner wall surface 111 is performed.

Figure 7:
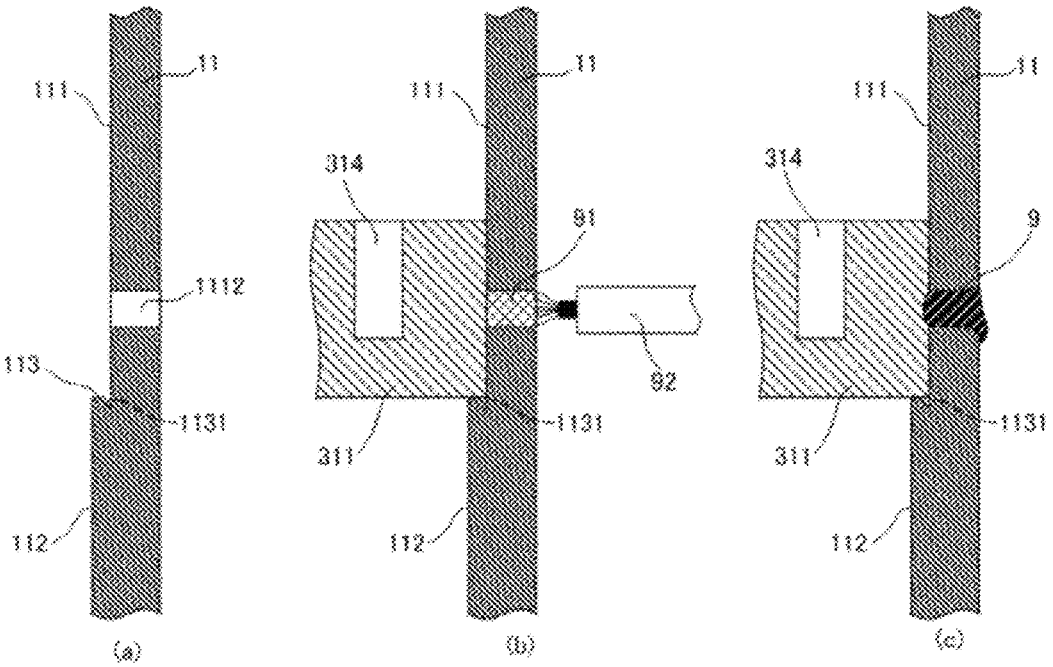
FIG. 7 illustrates a fixing step in which the fixed scroll is fixed to the main shell.

Here, the fixing step in which the fixed scroll 31 is fixed to the main shell 11 is described in detail with reference to FIG. 7. FIG. 7 illustrates the fixing step in which the fixed scroll is fixed to the main shell.

To fix the fixed scroll 31 to the main shell 11, the fixing step in which stress is applied from the outside in the radial direction of the main shell 11 toward the stress absorbers of the fixed scroll 31 is performed. Examples of "step in which the stress is applied" include shrink fitting, spot welding, punching, and a combination of these methods. According to Embodiment 1, the fixed scroll 31 is shrink-fitted into the main shell 11, and then ark spot welding is performed from portions of the main shell 11 close to the outer wall toward the recesses 314 of the fixed scroll 31. Specifically, as illustrated in FIG. 7 (*a*), welding holes 1112 for ark spot welding are provided in the main shell 11. The welding holes 1112 are each provided in advance. As illustrated in (b), the main shell 11 is heat expanded by, for example, high-frequency heating, and the fixed scroll 31 is inserted from the portion of the main shell 11 close to the one end portion U, thereby the fixed scroll 31 is positioned at the first projection 112. Subsequently, the main shell 11 is cooled for performing shrink fitting. Welding of a consumable electrode type such as MAG welding using a welding wire 91 containing Mn, Si, and C is performed on the welding holes 1112 provided in the overlap region 1111 serving as a shrink fitting region. That is, a large current is caused to flow through the welding wire 91 supplied from a welding torch 92. Radiant heat due to arc discharge generated at this time and latent heat energy of molten metal adhering to surrounding materials due to melting of the welding wire 91 cause surrounding materials to melt, thereby welding is performed. As a result, the welding wires 91 become the weld joints 9 as illustrated in (c) and connect the main shell 11 and the fixed scroll 31 to each other. Arc spot welding applies stress to the side surface of the fixed scroll 31 from the outside in the radial direction of the main shell 11 toward the recess 314 of the fixed scroll 31. Consequently, each of the weld joints 9 has such a shape that the weld joint 9 slightly penetrates into the side surface of the fixed scroll 31 as described above. Thus, whether the fixing step in which stress is applied toward the stress absorber is performed can be presumed on the basis of the shape of the weld joint 9 and a welding position.

At last, the upper shell 12 is inserted from the portion of the main shell 11 close to the one end portion U, and then, the main shell 11 and the upper shell 12 are fixed to each other by, for example, welding or ark spot welding. In so doing, the fixed scroll 31 is inserted by being pushed against the first positioning surface 113 by the upper shell 12 and, with this state maintained, fixed to the main shell 11. This operation suppresses variation in height of the refrigerant introduction space 37 from one scroll compressor to another, improves positional accuracy, and suppresses deviation of the level of the fixed scroll 31 in the up-down direction when the scroll compressor is driven. However, it is sufficient that the first projection 112 be at least able to serve as a location at which the fixed scroll 31 is positioned in the manufacture. Consequently, the fixed scroll 31 is not necessarily in contact with the first positioning surface 113 after the fixed scroll 31 has been fixed to the first inner wall surface 111. This relationship is similarly applicable to the relationship between the main frame 2 and the second projection 115.

As has been described, according to Embodiment 1, the fixed scroll 31 is fixed to the main shell 11 without forming, in the main frame 2, a wall for connecting the fixed scroll 31 as is the case with the related art. Thus, the size of the refrigerant introduction space 37 can be increased. Furthermore, as screws are not used, the manufacture can be simplified.

Furthermore, the fixing step in which stress is applied from the outside in the radial direction of the main shell 11 to the fixed scroll 31 is performed. Thus, a fixing strength of the same degree as that of the related-art fixing structure can be obtained. However, when the fixing step in which stress is applied from the outside in the radial direction of the main shell 11 to the fixed scroll 31 is performed, the fixed scroll 31 may be strained by the stress and deformed. For example, when the fixed scroll 31 is bent by the strain, the first scroll body 312 of the fixed scroll 31 may be caused to be deformed. This deformation may open a leakage gap in the compression chamber 34, resulting in reduction in compression efficiency. To suppress such strain, the recesses 314 as the stress absorbers are formed in the first base plate 311 of the fixed scroll 31. When stress is applied from the outside of the first base plate 311 in the radial direction, the recesses 314 blocks the stress at the outside of the recesses 314 and prevent the stress from acting on the formation region 315, which is disposed inside the recesses 314 and at which the first scroll body 312 is formed. Thus, compression efficiency can be maintained.

According to Embodiment 1, the fixed scroll 31 that forms the compression chamber 34 together with the orbiting scroll 32 and the main shell 11 that accommodates the orbiting scroll 32 and the fixed scroll 31 are provided. The fixed scroll 31 includes the first base plate 311 fixed to the main shell 11 and the first scroll body 312 projecting from the first base plate 311 toward the orbiting scroll 32. The first base plate 311 has the recesses 314 formed outside the first scroll body 312 in the radial direction and serving as the stress absorbers that absorb stress from the outside in the radial direction. Consequently, even when the fixing step in which stress is applied from the outside in the radial direction of the main shell 11 toward the stress absorbers of the fixed scroll 31 is performed to obtain the fixing strength equal to that of the related art, the occurrence of a situation in which the fixed scroll 31 is strained by the stress in the fixing step and the first scroll body 312 of the fixed scroll 31 is deformed to open a leakage gap in the compression chamber 34 can be suppressed. Furthermore, the recesses 314 serving as the stress absorbers are each provided on the line passing through the center C of the first base plate 311 and the corresponding one of the weld joints 9. Thus, for example, even when spot welding is performed from the overlap region 1111 where the main shell 11 and the first base plate 311 of the fixed scroll 31 are fixed to and overlap each other toward the recesses 314 after the main shell 11 and the fixed scroll 31 have been shrink-fitted together, strain of the fixed scroll 31 can be suppressed by using the stress absorbers.

The main shell 11 has the first inner wall surface 111 and the first projection 112 that projects from the first inner wall surface 111 and serves as a location at which the fixed scroll 31 is positioned. The fixed scroll 31 is fixed to the first inner wall surface 111. Thus, the fixed scroll 31 can be fixed to the main shell 11 with positioning accuracy for the fixed scroll 31 improved. Furthermore, the main frame 2 by which the orbiting scroll 32 is held in such a manner that the orbiting scroll 32 can slide is provided. The main shell 11 further has the second inner wall surface 114 and the second projection 115 that projects from the second inner wall surface 114 and serves as a location at which the main frame 2 is positioned. The main frame 2 is fixed to the second inner wall surface 114. Thus, the main frame 2 can be fixed to the main shell 11 with positioning accuracy for the main frame 2 improved. In addition, as manufacturing steps of the main frame 2 and the fixed scroll 31 are similar to each other, ease of the manufacture can be increased.

As the stress absorbers are formed in a region outside, in the radial direction, the formation region 315 for the first scroll body 312, the stress absorbers can suppress acting of the stress in the fixing step on the formation region 315 for the first scroll body 312. As the stress absorbers each have an arcuate shape along the outer circumference of the first base plate 311, the stress absorbers can absorb the stress in the fixing step even when the positions where the weld joints 9 are formed vary. Furthermore, as a plurality of the weld joints 9 and a plurality of the stress absorbers are formed, fixing strength of the fixed scroll 31 can be increased and strain of the fixed scroll 31 can be suppressed.

As the stress absorbers are the recesses 314 having the openings 3141 provided at portions of the first base plate 311 close to the one end portion U and opening at the one end portion U, the stress absorbers can be easily formed in the fixed scroll 31. Furthermore, as the weld joints 9 are each formed within the range of the depth of the corresponding one of the recesses 314 in the thickness direction of the first base plate 311, stress occurring when the weld joint 9 is formed can be effectively absorbed by the recess 314.

Embodiment 2

Figure 8:
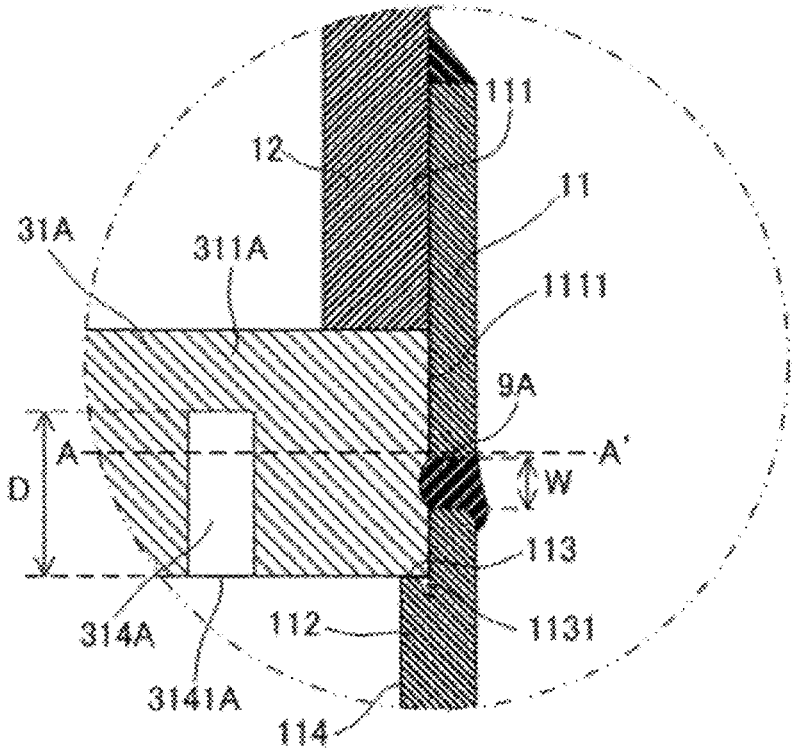
FIG. 8 illustrates a method of manufacturing a main shell according to Embodiment 2 of the present invention.

FIG. 8 is a sectional view of a scroll compressor according to Embodiment 2 of the present invention. In the following description including Embodiment 2 and Embodiment 3, parts having the same structures as those of the scroll compressor illustrated in FIGS. 1 to 7 are denoted by the same reference signs and description of the parts is omitted.

According to Embodiment 2, weld joints 9A are displaced in such a manner that the weld joints 9A are closer to portions where openings 3141A of recesses 314A are provided than is the center of a first base plate 311A of a fixed scroll 31A in the thickness direction. Furthermore, each of the recesses 314A is formed in such a manner that the corresponding one of the openings 3141A faces the other end portion L.

The weld joints 9A are displaced to the portions closer to the portions where the openings 3141A of the recesses 314A are provided. That is, according to Embodiment 2, the positions of the weld joints 9A are deviated from line A-A' passing through the center of an overlap region 1111A toward the other end portion L. Thus, even when the depth D of the recesses 314A is small, the entirety of the width W of the weld joints 9A can be easily disposed within the formation region of the recesses 314A. Consequently, even when the fixing step in which stress is applied toward the stress absorbers of the fixed scroll 31A is performed, the occurrence of a situation in which the fixed scroll 31A is strained by the stress in the fixing step and a first scroll body 312A of the fixed scroll 31A is deformed to open a leakage gap in compression can be suppressed.

According to Embodiment 2, the weld joints 9A are displaced in such a manner that the weld joints 9A are closer to the portions where the openings 3141A of the recesses 314A are provided than is the center of the first base plate 311A of the fixed scroll 31A in the thickness direction. Consequently, strain of the fixed scroll 31 due to the stress in the fixing step can be suppressed.

Embodiment 3

Figure 9:
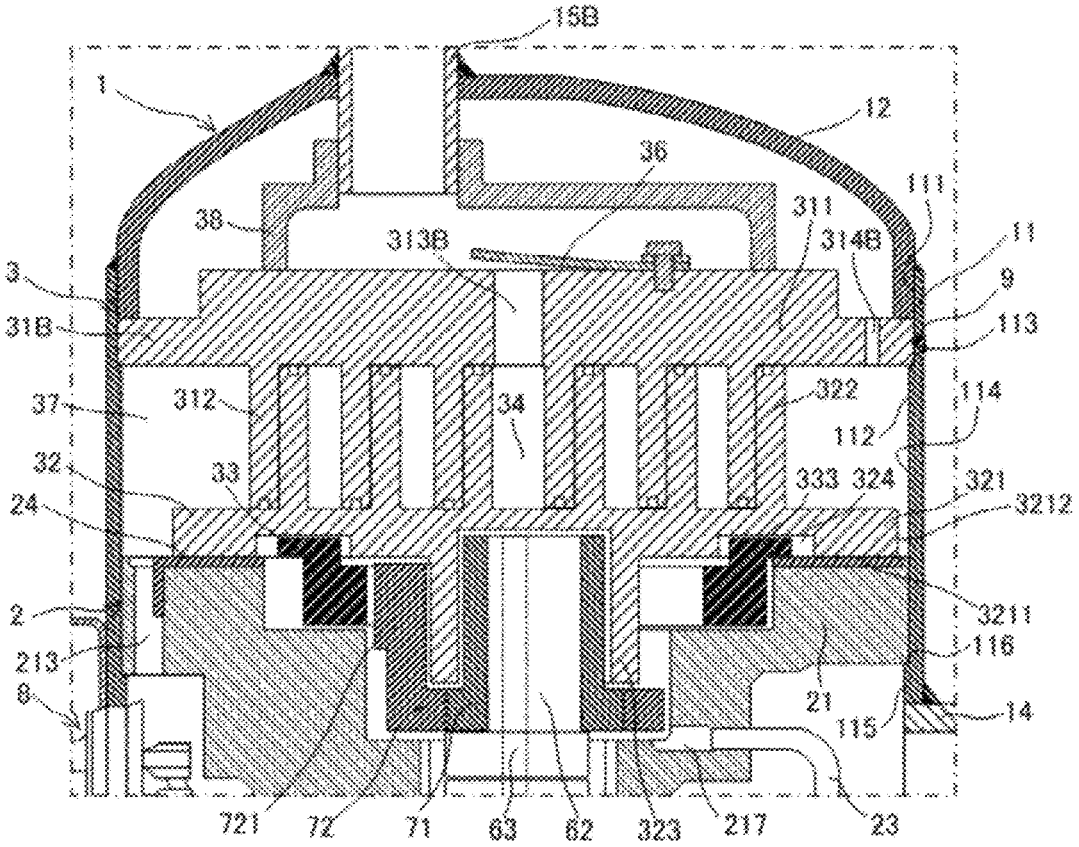
FIG. 9 is a sectional view of a scroll compressor according to Embodiment 3 of the present invention.

FIG. 9 is a sectional view of a scroll compressor according to Embodiment 3 of the present invention.

According to Embodiment 3, a chamber 38 is provided. The chamber 38 connects a discharge port 313B of a fixed scroll 31B and a discharge pipe 15B to each other. When the fixed scroll 31B is fixed to the main shell 11 by performing the fixing step in which stress is applied toward the stress absorbers of the fixed scroll 31B, a portion of the fixed scroll 31B outside the stress absorbers in the radial direction becomes easily deformed. This deformation may open a gap at part in an overlap region 1111B of the main shell 11 and the circumference of the fixed scroll 31B. In the case where the gap is opened, the refrigerant introduction space 37, which is a low-pressure space, and a region closer to the one end portion U than the fixed scroll 31B, the region being a high-pressure space, are connected to each other. This connection causes the compressed high-pressure refrigerant to flow backward to the refrigerant introduction space 37, thereby degrading the functions as the compressor. To address this problem, the discharge port 313B and the discharge pipe 15B are spatially directly connected each other. This connection can introduce the high-pressure refrigerant discharged from the discharge port 313B into the discharge pipe 15B without backflow of the high-pressure refrigerant to the refrigerant introduction space 37. Consequently, degradation of the functions as the compressor can be suppressed.

Figure 10:
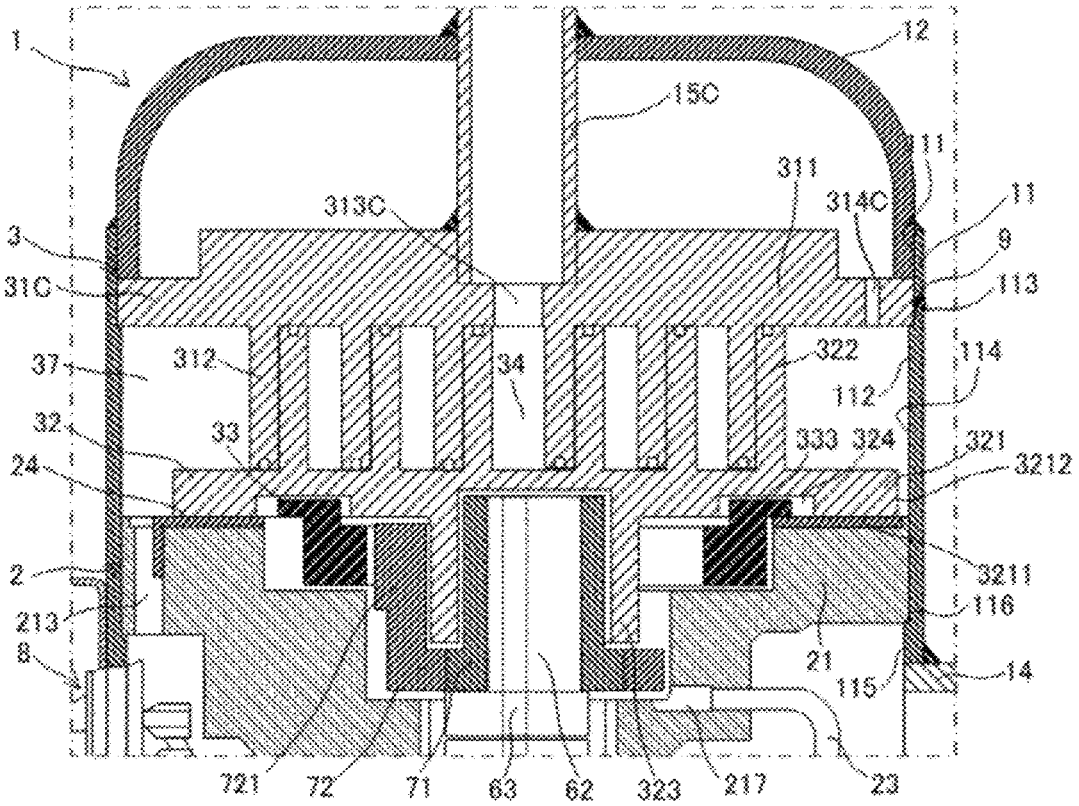
FIG. 10 is a sectional view of a scroll compressor according to variation 1 of the present invention.

Alternatively, as illustrated in FIG. 10, a discharge pipe 15C may be directly connected to a first base plate 311C of a fixed scroll 31C to directly connect the discharge pipe 15C and a discharge port 313C to each other. That is, the effects similar to those obtained with the case illustrated in FIG. 9 can be obtained even when the discharge pipe 15C is fixed to the fixed scroll 31C in such a manner that the discharge pipe 15C covers the discharge port 313C.

Furthermore, the stress absorbers are through holes 314B that penetrate through in the thickness direction of the fixed scroll 31B. As the high-pressure refrigerant discharged from the discharge port 313B is prevented from flowing backward to the refrigerant introduction space 37, a region closer to the one end portion U than the fixed scroll 31B and a region closer to the other end portion L than the fixed scroll 31B are positively made to be spaces of the same pressure. When the regions closer to the one end portion U and closer to the other end portion L than the fixed scroll 31B are the spaces of the same pressure, the temperature of the region above the fixed scroll 31 and the temperature of the region below the fixed scroll 31 are equal to each other. Thus, bending of the fixed scroll 31 due to thermal expansion can be suppressed. In particular, with a low-pressure shell, an effect of cooling most of the fixed scroll 31B with a low-pressure gas can also be obtained. Furthermore, as the stress absorbers are the through holes 314B, the entirety of the width W of the weld joints 9 can be disposed within the range of the through holes 314B. Thus, reduction in compression efficiency due to strain of the fixed scroll 31B can be suppressed.

According to Embodiment 3, the fixed scroll 31B is provided with the chamber 38. The chamber 38 hermetically connects the discharge port 313B and the discharge pipe 15B to each other. The discharge port 313B is formed in a first base plate 311B and allows discharge, through the discharge port 313B, of the refrigerant introduced from the suction pipe 14 of the shell 1 and compressed in the compression chamber 34. The discharge pipe 15B is formed in the shell 1 and allows discharge of the refrigerant to the outside through the discharge pipe 15B. Consequently, strain of the fixed scroll 31B due to stress in the fixing step can be suppressed. Furthermore, as the stress absorbers are the through holes 314B that penetrate through in the thickness direction of the first base plate 311B, strain of the fixed scroll 31 due to stress in the fixing step can be suppressed.

The present invention is not limited to the invention according to Embodiment 1 to Embodiment 3 having been described, and the present invention can be appropriately modified without departing from the gist of the present invention.

For example, although the scroll compressor according to Embodiment 1 to Embodiment 3 having been described is a vertical scroll compressor, the techniques herein can also be applied to a horizontal scroll compressor. In so doing, also in the horizontal scroll compressor, regarding the directions from the main frame, a portion where the compression mechanism unit is provided is referred to as the one end portion, and a portion where the drive mechanism unit is provided is referred to as the other end portion for description. Furthermore, the techniques herein can be applied not only to a low-pressure shell scroll compressor but also to a high-pressure shell scroll compressor in which the pressure in a space in the main shell where the drive mechanism unit is disposed is higher than the refrigerant introduction space.

The shape of the main shell 11 is not limited to a cylindrical shape. The shape of the main shell 11 may be another shape such as a polygonal prism. Furthermore, according to Embodiment 1 to Embodiment 3 described above, an effect of increasing, compared to the related art, the size of the refrigerant introduction space 37 between the first base plate 311 of the fixed scroll 31 and the thrust bearing of the main frame 2 in the main shell 11 is obtained. With this effect, the thrust load is reduced by increasing the diameter of the second base plate 321 of the orbiting scroll 32 and the diameter of the thrust plate 24 to increase a sliding area without changing the design of the scroll bodies and other parts from those of the related art. However, the configuration is not limited to the one described above.

Various shapes and various methods of manufacturing can be used for the first projection 112 and the first positioning surface 113 as long as positioning of the fixed scroll 31 can be accurately performed. It is sufficient that the first projection 112 be able to serve as a location at which the fixed scroll 31 is positioned. Thus, at least two projections formed on the inner wall surface of the main shell 11 may be used. Furthermore, the first projection 112 may be formed by punching the main shell 11 from the outside. Rotation of the fixed scroll 31 while the fixed scroll 31 faces the main shell 11 may be suppressed by forming a protrusion on the first positioning surface 113 and engaging this projection with a recess formed in the fixed scroll 31.

Protrusions (or recesses) may be formed in the inner wall surface of the main shell 11 in a direction along the axis of the crankshaft 6. In this case, a recess (or a protrusion) is formed in each of the main frame 2 and the fixed scroll 31 to be engaged with the corresponding one of the protrusions (or the recesses) formed in the inner wall of the main shell 11. With this structure, the first scroll body 312 of the fixed scroll 31 and the second scroll body 322 of the orbiting scroll 32 can be in phase. Consequently, a step of adjusting the phase by rotating the fixed scroll 31 while the fixed scroll 31 faces the orbiting scroll 32 can be omitted.

Figure 11:
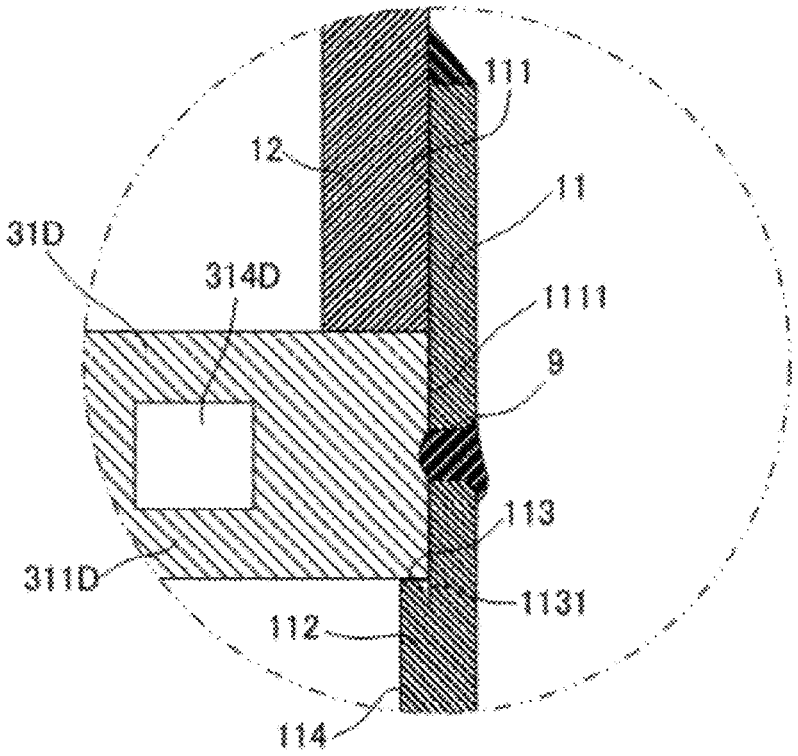
FIG. 11 is a sectional view of a scroll compressor according to variation 2 of the present invention.
Figure 12:
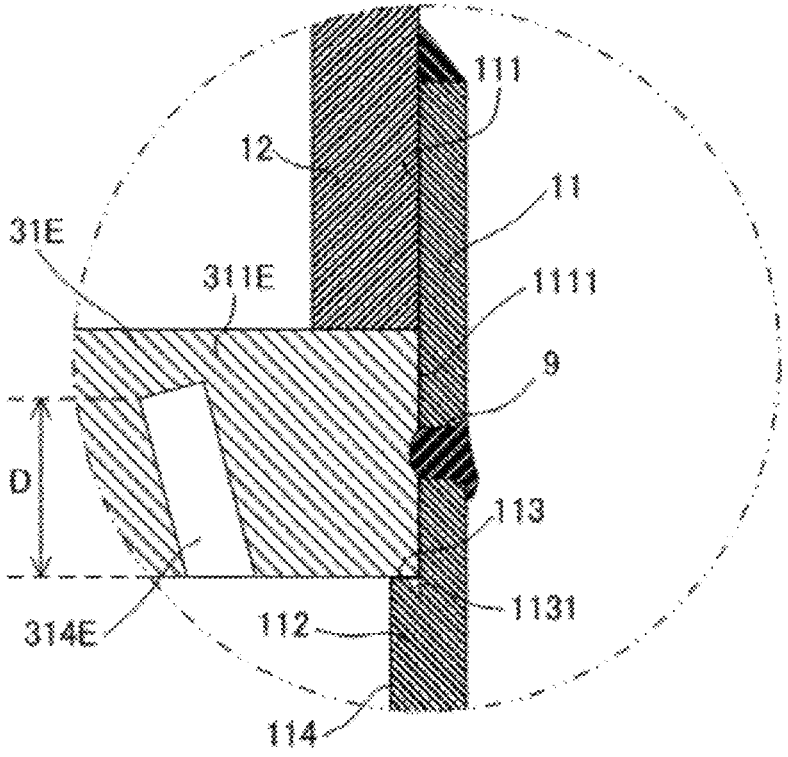
FIG. 12 is a sectional view of a scroll compressor according to variation 3 of the present invention.
Figure 13:
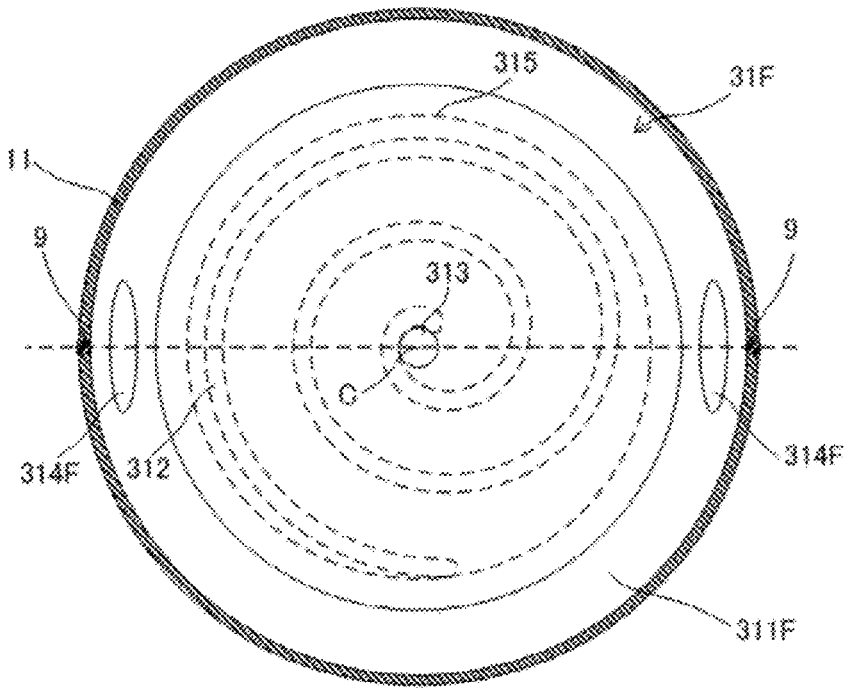
FIG. 13 is a sectional view of a scroll compressor according to variation 4 of the present invention.

The stress absorbers are not limited to those according to Embodiment 1 to Embodiment 3 described above. For example, as illustrated in FIG. 9, in the case where the through holes 314B are provided, one of the openings of each of the through holes 314B may be hermetically closed by a lid such as a metal plate to prevent communication between a space above the fixed scroll 31 and a space below the fixed scroll 31. Furthermore, with reference to FIG. 5, a plurality of the stress absorbers may be formed between the formation region 315 and the weld joints 9. In so doing, when the stress absorbers are the recesses 314, the recesses 314 open at the one end portion U and the recesses 314 open at the other end portion L may be staggered. Also, as the stress absorbers, cavities 314D may be formed in a first base plate 311D of a fixed scroll 31D as illustrated in FIG. 11, or recesses 314E inclined from the overlap region 1111 may be formed in a first base plate 311E of a fixed scroll 31E as illustrated in FIG. 12. Furthermore, as illustrated in FIG. 13, as the stress absorbers, recesses 314F each having an oblong opening may be provided in the first base plate 311E of the fixed scroll 31E.

Regarding the relationship between the weld joints 9 and the stress absorbers, the entirety of the width W of the weld joints 9 is not necessarily within the range of the depth D of the stress absorbers. For example, the effects according to the present invention can be obtained even in a relationship in which about a half of the width W of the weld joints 9 overlaps the range of the depth D of the recesses 314.

REFERENCE SIGNS LIST shell 11 main shell 111 first inner wall surface 1111 overlap region 1112 welding hole 112 first projection 113 first positioning surface 1131 recess 114 second inner wall surface 115 second projection 116 second positioning surface 1161 recess 12 upper shell 13 lower shell 14 suction pipe 15, 15B, 15C discharge pipe 16 fixing base 2 main frame 21 main body part 211 accommodating space 212 flat surface 213 suction port 214 Oldham accommodating part 215 first Oldham groove 22 main bearing part 221 shaft hole 23 lubricant return pipe 24 thrust plate 241 cut 242 bent part 3 compression mechanism unit 31, 31A, 31B, 31C, 31D, 31E, 31F fixed scroll 311, 311A, 311B, 311C, 311D, 311E first base plate 312, 312D first scroll body 313, 3136, 313C discharge port 314, 314A, 3146, 314C, 314D, 314E, 314F stress absorber (through hole, recess, cavity) 3141, 3141A opening 315 formation region 32, 32D orbiting scroll 321, 321D second base plate 322, 322D second scroll body 3211 sliding surface 3212 side surface 323 cylindrical part 324 second Oldham groove 33 Oldham ring 331 ring part 332 first key part 333 second key part 34 compression chamber 35 muffler 351 discharge hole 36 discharge valve 37 refrigerant introduction space 38 chamber 4 drive mechanism unit 41 stator 42 rotor 5 sub-frame 51 sub-bearing part 52 lubricant pump 6 crankshaft 61 main shaft part 62 eccentric shaft part 63 lubricant channel 7 bushing 71 slider 72 balance weight 721 weight part 8 power feed unit 81 cover 82 power feed terminal 83 wiring 9, 9A weld joint 91 welding wire 92 welding torch C center U one end portion L other end portion

The invention claimed is:

1. A scroll compressor, comprising:

an orbiting scroll;

a fixed scroll configured to form a compression chamber together with the orbiting scroll;

a shell that accommodates the orbiting scroll and the fixed scroll; and a frame that holds the orbiting scroll in such a manner that the orbiting scroll is able to slide, the fixed scroll including a base plate fixed to the shell, and a scroll body that projects from the base plate toward the orbiting scroll, the base plate having a plurality of stress absorbers that are formed outside the scroll body in a radial direction and that are each configured to absorb stress from an outer region in the radial direction, a plurality of weld joints being formed in an overlap region where the shell and the base plate are fixed to each other and overlap each other, the plurality of stress absorbers each being provided on a line that passes through a center of the base plate and a corresponding one of the plurality of weld joints, wherein the shell has a first inner wall surface and a first projection that projects from the first inner wall surface and that serves as a location at which the fixed scroll is positioned, the fixed scroll is fixed to the first inner wall surface, the shell further has a second inner wall surface and a second projection that projects from the second inner wall surface and that serves as a location at which the frame is positioned, the frame is fixed to the second inner wall surface, the shell includes at least a cylindrical main shell having upper and lower openings, an upper shell covering the upper opening, and a lower shell covering the lower opening, and the first and second inner wall surfaces are both formed on the cylindrical main shell.

2. The scroll compressor of claim 1, wherein the plurality of stress absorbers each have an arcuate shape along an outer periphery of the base plate.

3. The scroll compressor of claim 1, wherein the base plate of the fixed scroll is shrink-fitted to an inner wall of the shell, and wherein the plurality of weld joints are formed in a shrink fitting region of the base plate and the shell.

4. The scroll compressor of claim 1, wherein the plurality of stress absorbers are each a recess that has an opening provided in one end portion of the base plate.

5. The scroll compressor of claim 4, wherein the plurality of weld joints are formed within a range of a depth of the recess in a thickness direction of the base plate.

6. The scroll compressor of claim 4, wherein the plurality of weld joints are displaced in such a manner that the plurality of weld joints are closer to a portion where the opening is provided than is a center in a thickness direction of the base plate.

7. The scroll compressor of claim 1, wherein the fixed scroll is provided with a chamber that hermetically connects a discharge port and a discharge pipe to each other, wherein the discharge port is formed in the base plate and allows discharge, through the discharge port, of refrigerant introduced from a suction pipe of the shell and compressed in the compression chamber, and wherein the discharge pipe is formed in the shell and allows discharge of the refrigerant to an outside through the discharge pipe.

8. The scroll compressor of claim 1, wherein the fixed scroll has a discharge port that is formed in the base plate and that allows discharge, through the discharge port, of refrigerant introduced from a suction pipe of the shell and compressed in the compression chamber, wherein the shell has a discharge pipe that allows discharge of the refrigerant to an outside through the discharge pipe, and wherein the discharge pipe is fixed to the fixed scroll in such a manner that the discharge pipe covers the discharge port.

9. The scroll compressor of claim 7, wherein the plurality of stress absorbers are each a through hole that penetrate through in a thickness direction of the base plate.

10. A method of manufacturing a scroll compressor, the scroll compressor including an orbiting scroll, a fixed scroll configured to form a compression chamber together with the orbiting scroll, a shell that accommodates the orbiting scroll and the fixed scroll, and a frame that holds the orbiting scroll in such a manner that the orbiting scroll is able to slide, the fixed scroll including a base plate fixed to the shell, and a scroll body that projects from the base plate toward the orbiting scroll, the base plate having a plurality of stress absorbers that are formed outside the scroll body in a radial direction and that are each configured to absorb stress from an outer region in the radial direction, the method comprising fixing in which stress is applied from an outside in the radial direction of the shell toward each of the plurality of stress absorbers of the fixed scroll, the fixing including forming a plurality of weld joints in an overlap region where the shell and the base plate are fixed to each other and overlap each other in such a manner that the plurality of stress absorbers are each provided on a line that passes through a center of the base plate and a corresponding one of the plurality of weld joints, wherein the shell has a first inner wall surface and a first projection that projects from the first inner wall surface and that serves as a location at which the fixed scroll is positioned, the fixed scroll is fixed to the first inner wall surface, the shell further has a second inner wall surface and a second projection that projects from the second inner wall surface and that serves as a location at which the frame is positioned, the frame is fixed to the second inner wall surface, the shell includes at least a cylindrical main shell having upper and lower openings, an upper shell covering the upper opening, and a lower shell covering the lower opening, and the first and second inner wall surfaces are both formed on the cylindrical main shell.

11. The method of claim 10, wherein the fixing includes spot welding performed from the outside in the radial direction of the shell toward each of the plurality of stress absorbers of the fixed scroll.

12. The method of claim 11, wherein the base plate of the fixed scroll is shrink-fitted to an inner wall of the shell, the method further comprising spot-welding a shrink fitting region of the base plate and the shell.

* * * * *